US005178596A

United States Patent [19]

McIntire

[11] Patent Number: 5,178,596

[45] Date of Patent: Jan. 12, 1993

[54] EXERCISE APPARATUS

[76] Inventor: Nora L. McIntire, 4420 Fortune Cir. S., Colorado Springs, Colo. 80917

[21] Appl. No.: 806,473

[22] Filed: Dec. 13, 1991

[51] Int. Cl.[5] ..... A63B 23/08

[52] U.S. Cl. ..... 482/80; 482/122; 482/125; 482/126; 482/128; 482/909

[58] Field of Search ..... 482/79, 80, 121, 122, 482/123, 124, 125, 126, 128, 909, 49

[56] References Cited

U.S. PATENT DOCUMENTS

| | | | |
|---|---|---|---|
| 980,634 | 1/1911 | Hazelton | 482/80 |
| 1,734,238 | 11/1929 | Sweeney | 482/124 |
| 2,160,722 | 5/1939 | Cunningham | 482/79 |
| 2,206,902 | 7/1940 | Kost | 482/80 |
| 2,845,063 | 7/1958 | Allen | 482/79 |
| 3,295,847 | 1/1967 | Matt, Sr. | 482/128 |
| 3,741,540 | 6/1973 | Shimizu | 482/80 |
| 4,111,146 | 9/1978 | Jinotti | 482/80 |
| 4,262,898 | 4/1981 | Lee | 482/49 |
| 4,502,680 | 3/1985 | Blum et al. | 482/80 |

*Primary Examiner*—Richard J. Apley
*Assistant Examiner*—Lynne A. Reichard
*Attorney, Agent, or Firm*—Leon Gilden

[57] ABSTRACT

An exercise apparatus for use by individuals includes a base member formed of hingedly secured base members that in turn each include a hinged pivot plate relative to each base plate, wherein each pivot plate is biased exteriorly of each base plate, and at least one elastomeric band mounted to each base plate to permit simultaneous foot, leg, and arm exercise by individuals in areas of limited available space.

2 Claims, 4 Drawing Sheets

EXERCISE APPARATUS

BACKGROUND OF THE INVENTION

1. Field of the Invention

The field of invention relates to exercise apparatus, and more particularly pertains to a new and improved exercise apparatus wherein the same is arranged for use in confined areas, such as airplanes, automobile travel, and the like.

2. Description of the Prior Art

Exercise apparatus of various types have been utilized throughout the prior art to accommodate specialized conditions. Exercise apparatus of the prior art is exemplified in U.S. Pat. No. 4,305,578 to Disbrow, et al. as a bicycle type exercise apparatus.

U.S. Pat. No. 4,838,543 to Armstrong, et al. sets forth a stair-stepping type exercise apparatus.

U.S. Pat. No. 4,961,569 to Roberge sets forth arm levers that are pivotally mounted relative to a stationary bicycle structure.

U.S. Pat. No. 4,482,152 to Wolff sets forth an exercise apparatus utilizing various sprockets and levers to permit exercise of various leg and arm portions of an individual.

As such, it may be appreciated that there continues to be a need for a new and improved exercise apparatus as set forth by the instant invention which addresses both the problems of ease of use as well as effectiveness in construction in application to areas of confined space and in this respect, the present invention substantially fulfills this need.

SUMMARY OF THE INVENTION

In view of the foregoing disadvantages inherent in the known types of exercise apparatus now present in the prior art, the present invention provides an exercise apparatus wherein the same is arranged for use in confined spatial areas. As such, the general purpose of the present invention, which will be described subsequently in greater detail, is to provide a new and improved exercise apparatus which has all the advantages of the prior art exercise apparatus and none of the disadvantages.

To attain this, the present invention provides an exercise apparatus for use by individuals including a base member formed of hingedly secured base members that in turn each include a hinged pivot plate relative to each base platey, wherein each pivot plate is biased exteriorly of each base plate, and at least one elastomeric band mounted to each base plate to permit simultaneous foot, leg, and arm exercise by individuals in areas of limited available space.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is importantly, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise apparatus which has all the advantages of the prior art exercise apparatus and none of the disadvantages.

It is another object of the present invention to provide a new and improved exercise apparatus which may be easily and efficiently manufactured and marketed.

It is a further object of the present invention to provide a new and improved exercise apparatus which is of a durable and reliable construction.

An even further object of the present invention is to provide a new and improved exercise apparatus which is susceptible of a low cost of manufacture with regard to both materials and labor, and which accordingly is then susceptible of low prices of sale to the consuming public, thereby making such exercise apparatus economically available to the buying public.

Still yet another object of the present invention is to provide a new and improved exercise apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
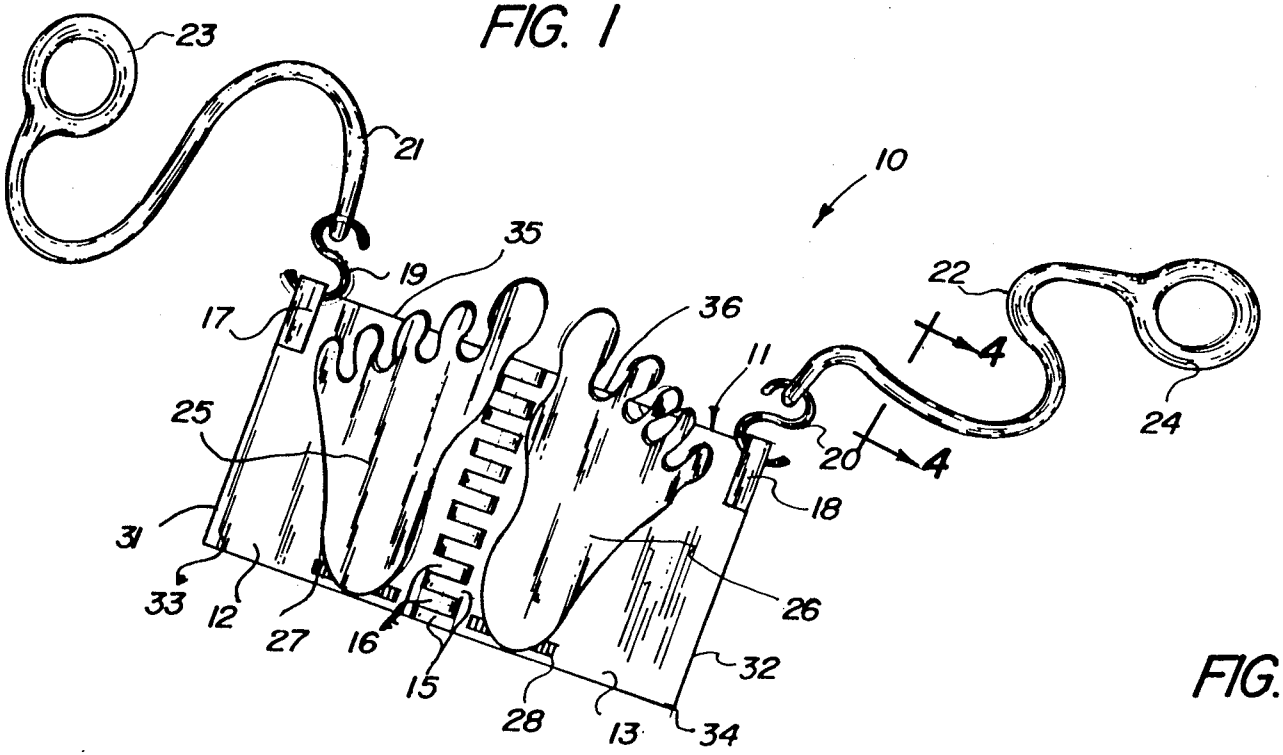
FIG. 1 is an orthographic top view of the instant invention.
Figure 2:
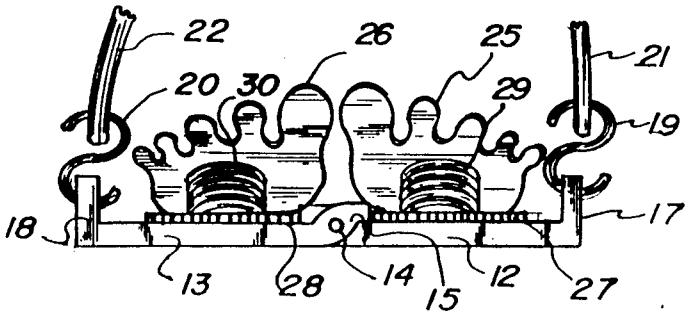
FIG. 2 is an orthographic front view of the instant invention.
Figure 3:
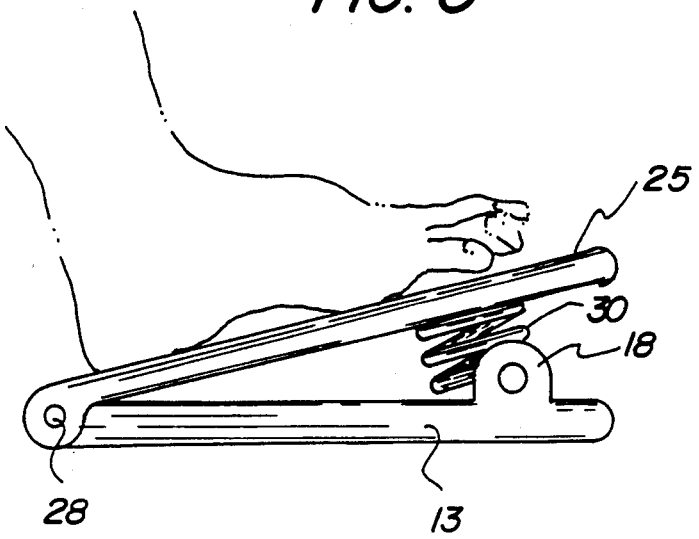
FIG. 3 is an orthographic side view of the instant invention.
Figure 4:
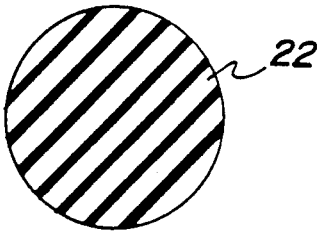
FIG. 4 is an orthographic view, taken along the lines 4—4 of FIG. 1 in the direction indicated by the arrows.

With reference now to the drawings, and in particular to FIGS. 1 to 12 thereof, a new and improved exercise apparatus embodying the principles and concepts of the present invention and generally designated by the reference numerals 10 and 10*a* will be described.

Figure 5:
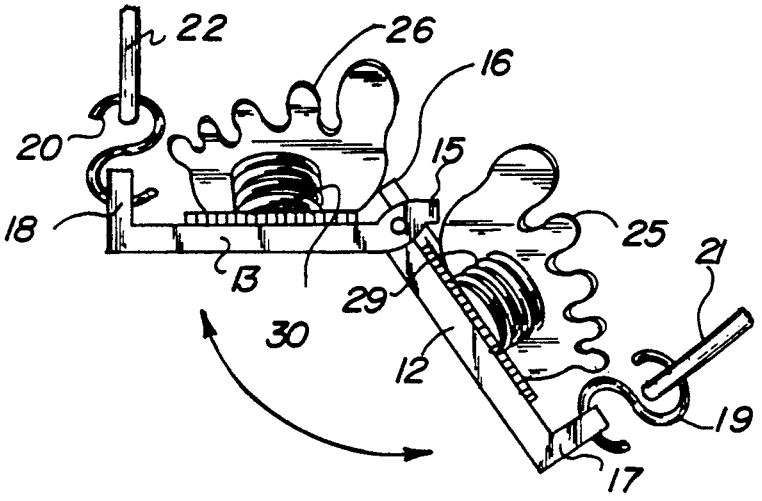
FIG. 5 is an orthographic view of the invention in a partially folded configuration.

More specifically, the exercise apparatus 10 of the instant invention essentially comprises a base member 11, including a first base plate 12 hingedly mounted to a second base plate 13 about a hinge axle 14. A plurality of second base plate fingers 15 extending exteriorly of an interior edge of the second base plate are arranged for abutment with an interior edge of the first base plate and are interdigited with a plurality of first base plate fingers 16 fixedly mounted to an interior surface of the first base plate that are arranged for abutment with the second base plate interior edge interdigited with the second base plate fingers 15, in a manner as illustrated in the FIGS. 1 and 5 for example. The first and second base plates 12 and 13 respectively include respective first and second base plate outer side edges 31 and 32 that are parallel relative to one another, as well as first and second base plate rear edges 33 and 34 that are collinear When the base plates are in an extended first position and are remaining in a coplanar relationship when the base plates are in a second folded orientation , such as illustrated in FIG. 5. Similarly, the first base plate 12 and the second base plate 13 includes respective first and second base plate forward edges 35 and 36 arranged forwardly and parallel relative to the rear edges that are collinear in the first position and remain coplanar in the second folded position, such as in FIG. 5. A first support anchor 17 and a second support anchor 18 are mounted to the respective first and second base plate outer side edges 31 and 32 respectively supporting pivotally a respective first and second pivot clip 19 and 20. Mounted to the respective first and second pivot clips 19 and 20 are respective first and second elastomeric cords 21 and 22 that include at their outer distal ends respective first and second handles 23 and 24. A first and second pivot plate 25 and 26 are pivotally mounted to the first and second base plates, with the first and second pivot plates 25 and 26 including respective first and second hinges 27 and 28 that are hingedly mounted relative to the respective first and second rear edges 33 and 34. Respective first and second spring members 29 and 30 are mounted in a captured relationship between the bottom surface of the respective first and second pivot plates 25 and 26 and top surfaces of the respective first and second base plates 12 and 13 to normally bias the pivot plates 25 and 26 in a raised orientation.

In this manner, an individual positions the individual's feet upon the pivot plates 25 and 26 while simultaneously grasping the handles 23 and 24 to permit simultaneous exercise of an individual's arms and legs. The interdigited and abutting relationship of the second and first base plate fingers 15 and 16 effect maintenance and coplanar alignment of the first and second base plates 12 and 13 in the first position.

Figure 6:
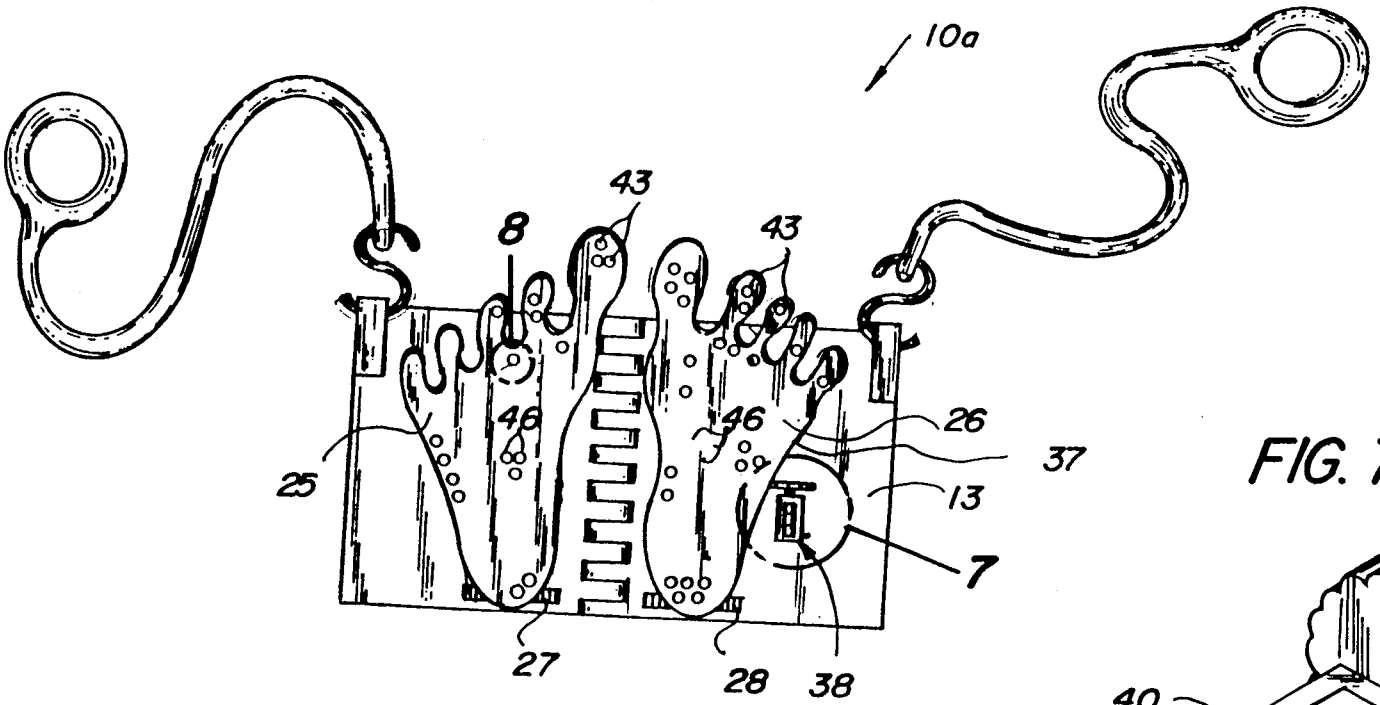
FIG. 6 is an orthographic top view of a modification of the invention.
Figure 7:
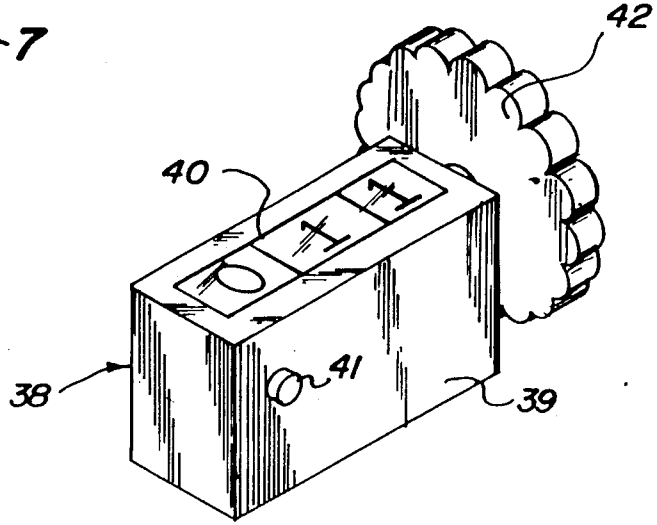
FIG. 7 is an isometric illustration of a counter structure utilized by the invention.
Figure 8:
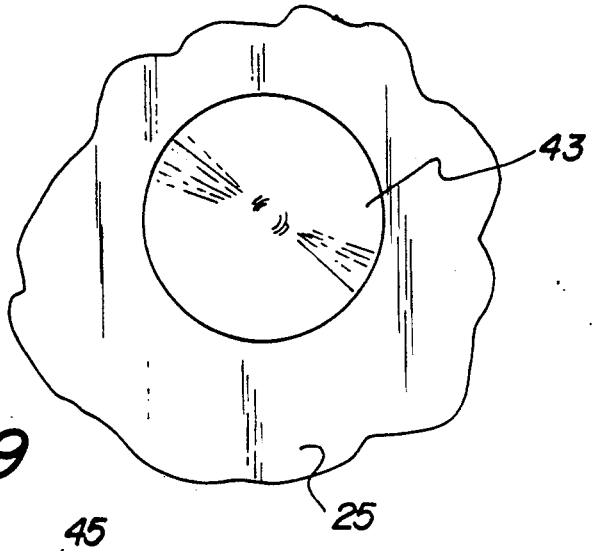
FIG. 8 is an orthographic top view, somewhat enlarged, of section 8 as set forth in FIG. 6.
Figure 9:
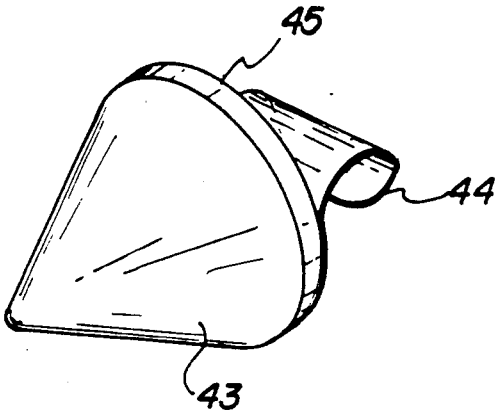
FIG. 9 is an isometric illustration of a massage projection utilized by the invention.
Figure 10:
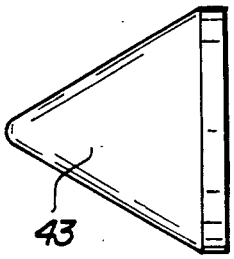
FIG. 10 is an orthographic side view of the projection as set forth in FIG. 9.
Figure 11:
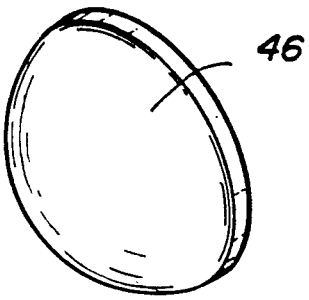
FIG. 11 is an isometric illustration of a further massage projection utilized by the invention.
Figure 12:
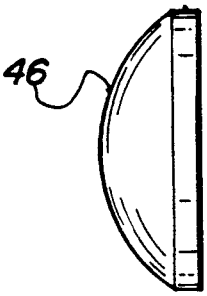
FIG. 12 is an orthographic side view of the massage projection as set forth in FIG. 11.

The invention as set forth in FIG. 6 and set forth as exercise apparatus 10*a* includes the organization as depicted in the FIG. 1 for example, but to further include a counter assembly 38 positioned adjacent the second pivot plate 26, wherein the counter assembly 38 includes a counter housing 39, with a display face 40 indicating a digital display of deflections of the second base plate, with a reset button 41, wherein the counter housing 39 includes a scalloped actuator wheel 42 rotatably mounted relative to the housing 39. The scalloped wheel is arranged in tangential alignment with the second base plate perimeter side edge 37 that is oriented above the second base plate 13 and the actuator wheel 42. Upon downward pivotment of the second pivot plate 26, rotation of the wheel 42 is effected to provide for the numbering of such movements of the second pivot plate 26. It is understood that a counter assembly may be utilized in conjunction with the first pivot plate 25, but for practical purposes, only one such counter is typically required.

The first and second pivot plates 25 and 26 are also arranged for utilizing a matrix of massage projections, including respective conical massage projections 43 positioned about the periphery of each pivot plate 25 and 26, wherein the conical projections each include a peel-away layer 44 at the base of each conical projection to expose an adhesive base surface 45. Such a peel-away layer and adhesive base surface is provided with semi-cylindrical projections 46 that are positioned medially of each first and second pivot plate to massage interior surfaces of an individual's feet, wherein the sharper conical projections provide enhanced massage and circulation to the outer periphery of an individual's feet to enhance circulation in the typically less sensitive outer periphery portions of an individual's feet, whereas the rounded hemi-spherical portions 46 provide for a softer application of massaging pressure to more sensitive interior portions of a foot's bottom surface.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described , and accordingly , all suitable modifications and equivalents may be resorted to, falling within the scope of the invention.

What is claimed as being new and desired to be protected by Letters Patent of the United States is as follows:

1. An exercise apparatus, comprising, a base member, the base member including a first base plate and a second base plate, wherein the first base plate includes a first base plate interior edge in confrontation to a second base plate interior edge, and a hinge axle secured relative to the first plate interior edge and the second base plate interior edge to secure the first base plate to the second base plate in hinged inter-relationship, and the first base plate including a first base plate outer side edge, and the second base plate including a second base plate outer side edge, wherein each outer side edge is arranged in a parallel spaced relationship relative to one another, and a first base plate rear edge arranged in a coplanar relationship to a second base plate rear edge, and the first base plate and the second base plate are arranged for pivotal movement from a first coplanar relationship to a second pivoted relationship, wherein the first base plate rear edge and the second base plate rear edge are coplanar in the second pivoted relationship, and a first support anchor mounted fixedly to a top surface of the first base plate adjacent the first base plate outer side edge, and a second support anchor fixedly mounted to a top surface of the second base plate adjacent the second base plate outer side edge, and a first pivot clip mounted to the first anchor, and a second pivot clip mounted to the second anchor, and a first elastomeric cord mounted to the first pivot clip, and a second elastomeric cord mounted to the second pivot clip, and a first handle integrally secured to an outer distal end of the first cord spaced from the first anchor, and a second handle mounted to the second elastomeric cord at an outer distal end thereof spaced from the second anchor, and including a first pivot plate pivotally mounted to the first base plate, and a second pivot plate mounted to the second base plate, wherein the first pivot plate includes a first pivot hinge positioned adjacent the first base plate rear edge, and the second pivot plate includes a second pivot hinge pivotally mounted adjacent the second base plate rear edge, wherein the first hinge and the second hinge are arranged in a collinear relationship, and a first spring captured between the first pivot plate and the first base plate, and a second spring mounted between the second pivot plate and the second base plate to normally bias the respective first pivot plate and the second pivot plate exteriorly of the first base plate and the second base plate respectively, and a counter assembly, the counter assembly fixedly mounted to the second base plate adjacent the second pivot plate, and the second pivot plate including a second plate perimeter side edge, and the counter assembly including a counter housing, with the counter housing including a display face and an actuator wheel rotatably mounted to the counter housing to effect sequential display of numerical total within the display face, and the actuator wheel including a scalloped perimeter edge, and the scalloped perimeter edge tangentially aligned below the second pivot plate perimeter side edge to effect rotation of the actuator wheel upon downward pivotment of the second pivot plate.

2. An apparatus as set forth in claim 1 including a plurality of resilient conical massaging projections mounted fixedly to each top surface, with the first pivot plate and the second pivot plate adjacent the first pivot plate outer perimeter side edge and the second pivot plate perimeter side edge, and a plurality of hemispherical projections mounted to the top surface of the first pivot plate and to the second pivot plate medially of the first pivot plate and the second pivot plate to effect massage of interior portions of an individual's feet when positioned upon the first pivot plate and the second plate.

* * * * *